US005490353A

United States Patent [19]

McLaughlin

[11] Patent Number: 5,490,353

[45] Date of Patent: Feb. 13, 1996

[54] ELEGANT PLANTATION SECURITY SHUTTER ASSEMBLY

[76] Inventor: Robert McLaughlin, 2040 Eastridge Ave.; Ste. B-4, Riverside, Calif. 92507

[21] Appl. No.: 324,515

[22] Filed: Oct. 14, 1994

[51] Int. Cl.[6] ..... E06B 7/08

[52] U.S. Cl. ..... 49/64; 49/74.1

[58] Field of Search ..... 49/64, 74.1, 171, 49/169, 67, 95, 94

[56] References Cited

U.S. PATENT DOCUMENTS

| | | | |
|---|---|---|---|
| 3,183,547 | 5/1965 | Bury | 49/67 X |
| 4,175,357 | 11/1979 | Goldhaber | 49/67 X |
| 4,606,145 | 8/1986 | Trombettas | 49/395 X |
| 4,630,396 | 12/1986 | Zvi et al. | 49/395 X |
| 4,663,885 | 5/1987 | Stibolt | 49/67 |
| 4,688,351 | 8/1987 | Torres | 49/74.1 |
| 4,967,509 | 11/1990 | Storey et al. | 49/64 X |

*Primary Examiner*—Philip C. Kannan
*Attorney, Agent, or Firm*—Michael I. Kroll

[57] ABSTRACT

An elegant plantation security shutter assembly for a window in a wall of a building comprising a casing with components for reinforcing the casing. Structures are for mounting the casing onto the wall behind the window. A pair of shutters are provided, with elements for reinforcing each shutter. Paraphernalia is for securing each shutter within the casing, so as to stop a thief from an unauthorized entry through the window into the building, by preventing the thief from breaking the shutters and the casing.

9 Claims, 3 Drawing Sheets

ELEGANT PLANTATION SECURITY SHUTTER ASSEMBLY

BACKGROUND OF THE INVENTION

1. Field of the Invention

It has become apparent that criminal activity is continually on the rise nationwide. The budget of most cities and states continues to shrink, which then effects law enforcement agencies to do the same. It is a sad but true fact, that many public places and parks have become dangerous war zones. It used to be that the government's most basic responsibility was the protection of its citizens. Sadly, it is a responsibility that our states are failing to live up to. Meanwhile, taxpayers face ever higher bills, while getting fewer important services to show for it.

It has now become necessary for the people of all communities to take a stand and actively support the prosecutions of all those committing crimes in their neighborhoods. Also, communities have to come together and determine the best way to combat the rising crime rate. Due to the continually rising crime rate everywhere, there is an awareness of safety and security among people today. It has now become a necessity to effectively protect you and your loved ones from crime.

The instant invention relates generally to window security devices and more specifically it relates to an elegant plantation security shutter assembly.

2. Description of the Prior Art

Numerous window security devices have been provided in prior art that are each adapted to prevent the unauthorized entry of a thief to enter the premises in a building. While these units may be suitable for the particular purpose to which they address, they would not be as suitable for the purposes of the present invention as heretofore described.

The industries and marketing statistics show that in home security, over two million dollars is spent daily. This clearly states that there is a positive market out there for a residential and commercial business security product. The residential and commercial business security industry consists of, standard alarm companies and companies who specialize in interior folding, sliding security gates and window bars.

It has been stated by people that the interior folding security gates and the window bars are tasteless. In residential neighborhoods these security gates and window bars are not popular because of their looks. Even home-owner associations will not allow any of their home owners to have these security gates or bars. The reason for this is because the value of the homes will go down, due to the fact that these bars and gates will make a neighborhood appear to look unsafe to live in, so that people will not buy homes there.

Alarm systems used to offer a sense of security until now. It is a known and true fact that in commercial business area, alarm systems are being bypassed by the criminals. They have found that by breaking into utility rooms and cutting all the phone lines, they would disable the alarm systems from dialing the monitoring company. In residential areas, alarm systems are very easy to disarm, because most phone access boxes are right out in front of people's homes and are accessible to anyone.

SUMMARY OF THE INVENTION

Plantation shutters are commonly referred to as wide-louver shutters. These shutters are very popular for their beauty and elegance. The elegant plantation security shutter assembly was invented and developed with the same elegant look and style but, with a security feature added. This security features is what will serve as a physical deterrent to thieves. The elegant plantation security shutter assembly, was invented with the specific intent of developing an effective product that will enhance personal safety and security. This security feature includes flat steel bars about the exterior edges of each of a pair of shutters. The shutters are then hinged to a reinforced steel casing at a window on a wall of a building, to prevent a brake in through the window by a thief.

The elegant plantation security shutter assembly is to be marketed as a thief deterrent for the unwanted intrusion of a perpetrator. This type of product is considered to be in the same marketing category of home security. There is a definite and positive market for a product like this and can be very profitable. The elegant plantation security shutter assembly is a marketable product in the interior decorating profession, for the elegant decor it displays in a home.

There is no doubt that the elegant plantation security shutter assembly is a product that sells itself, because of the many features it has to offer all in the one product. The benefits of the instant invention are many. It insulates homes and businesses and also offers the beauty and privacy of wide louver wooden shutters. The physical protection it provides almost eliminates the need for an alarm system. The benefit home owners also get, is a higher resale value of their homes. Home owners will like the idea that they can get a discount on their home owners insurance, when they have the elegant plantation security shutter assembly installed into their homes, because it will serve as a physical deterrent to unwanted perpetrators.

A primary object of the present invention is to provide an elegant plantation security shutter assembly that will overcome the shortcomings of the prior art devices.

Another object is to provide an elegant plantation security shutter assembly, in which each of a pair of shutters is reinforced with flat steel bars about the top, bottom and sides, so as to strengthen the shutters to prevent breakage by a thief.

An additional object is to provide an elegant plantation security shutter assembly, in which a casing the shutters are hinged to, is also reinforced with steel, so as to prevent the thief from braking out the casing and removing the shutters for an illegal entry through a window.

A further object is to provide an elegant plantation security shutter assembly that is simple and easy to use.

A still further object is to provide an elegant plantation security shutter assembly that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 2 is a perspective view of a portion of the wall showing one of the mounting brackets for the shutter casing to be affixed to.

DETAILED DESCRIPTION OF THE PREFERRED EMBODIMENTS

Figure 1:
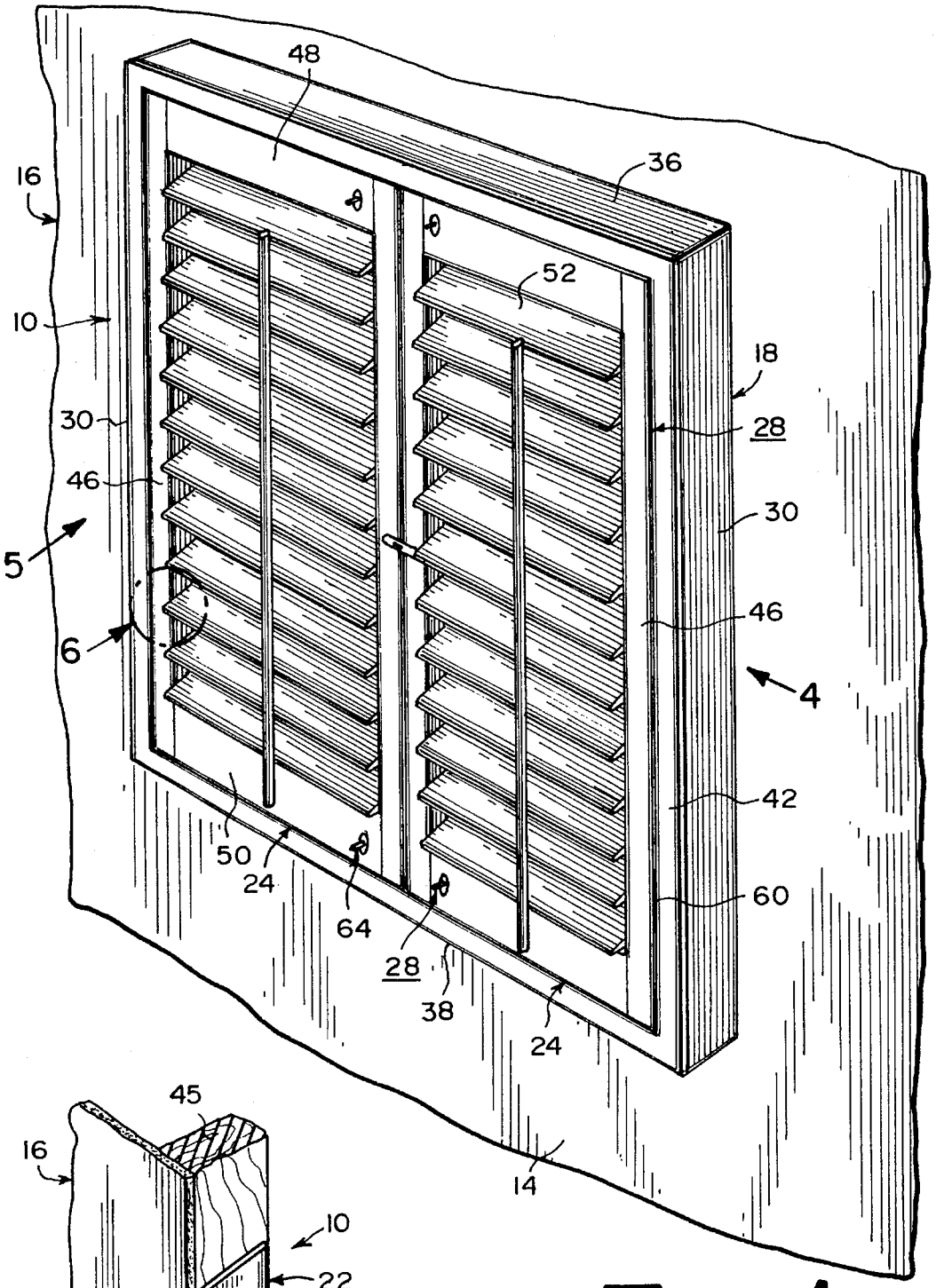
FIG. 1 is a perspective view of the instant invention installed on a wall in front of a window.
Figure 2:
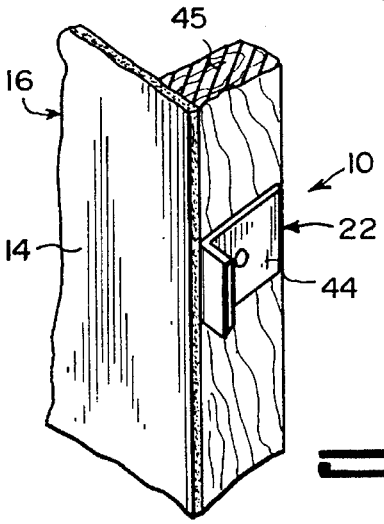
Figure 3:
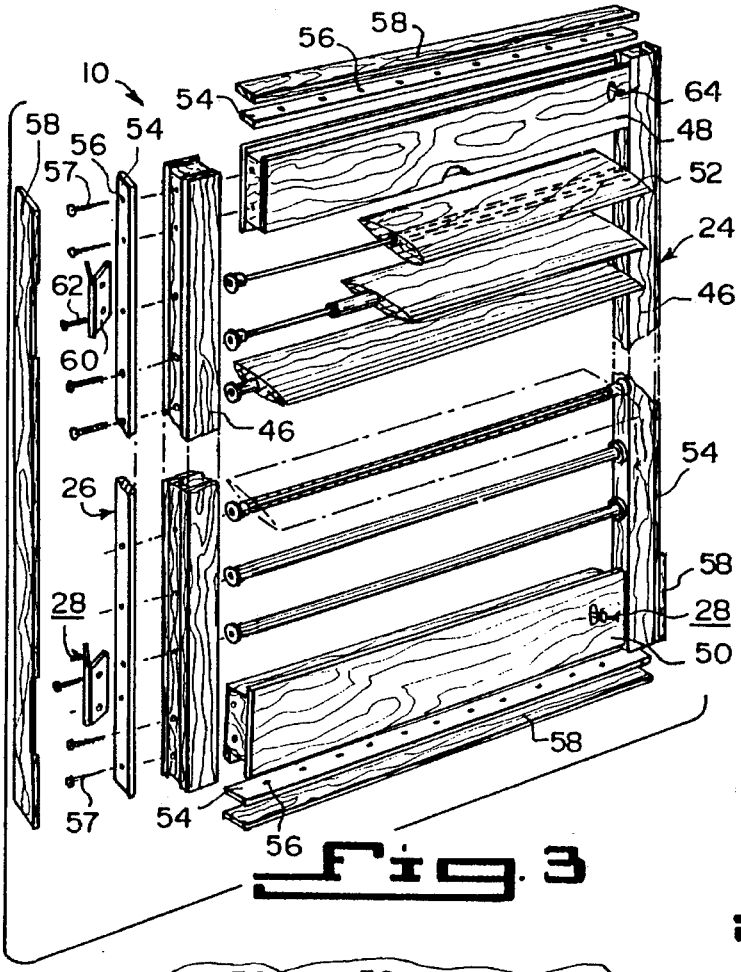
FIG. 3 is a partial exploded perspective view of one of the shutters with parts broken away.
Figure 4:
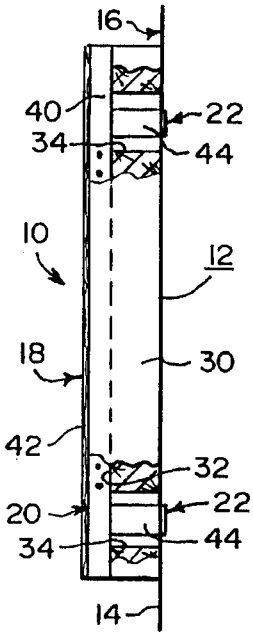
FIG. 4 is a diagrammatic side view taken in the direction of arrow 4 in FIG. 1, with parts broken away, to show the mounting brackets within the casing.
Figure 5:
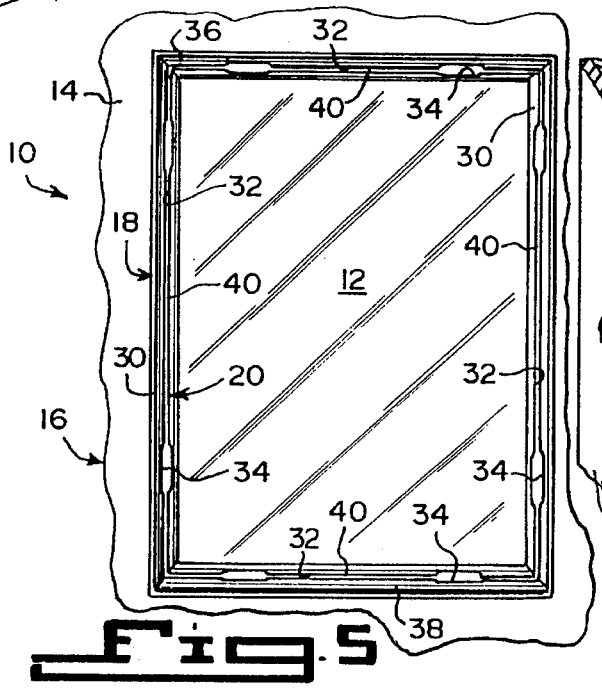
FIG. 5 is a front view taken in the direction of arrow 5 in FIG. 1, with the shutters and the front face moulding on the casing removed therefrom.
Figure 6:
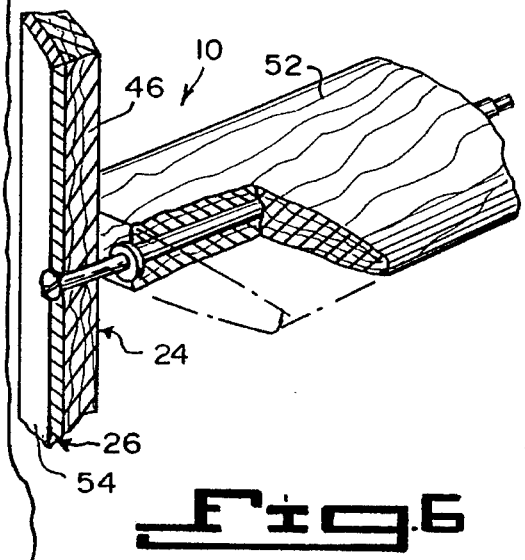
FIG. 6 is an enlarged perspective view as indicated by arrow 6 in FIG. 1, with parts broken away and in section.

Turning now descriptively to the drawings, in which similar reference characters denote similar elements throughout the several views, FIGS. 1 through 7 illustrate an elegant plantation security shutter assembly 10 for a window 12 in a wall 14 of a building 16, comprising a casing 18 with components 20 for reinforcing the casing 18. Structures 22 are for mounting the casing 18 onto the wall 14 behind the window 12. A pair of shutters 24 are provided, with elements 26 for reinforcing each shutter 24. Paraphernalia 28 is for securing each shutter 24 within the casing 18, so as to stop a thief from an unauthorized entry through the window 12 into the building 16, by preventing the thief from breaking the shutters 24 and the casing 18.

The casing 18 includes a pair of wooden side jambs 30, each having a central channel slot 32 and a pair of spaced apart mortise holes 34. A wooden top jamb 36 has a central channel slot 32 and a pair of spaced apart mortise holes 34. A wooden bottom jamb 38, has a central channel slot 32 and a pair of spaced apart mortise holes 34.

The casing reinforcing components 20 are four flat steel bars 40, each to fit into one of the central channel slots 32 in the side jambs 30, the top jamb 36 and the bottom jamb 38. The casing 18 further includes four wooden front face mouldings 42, to cover the flat steel bars 40 in central channel slots 32 in the side jambs 30 and the top and bottom jambs 36, 38.

The casing mounting structure 22 consists of eight brackets 44. Each bracket 44 is affixed to one edge of one flat steel bar 40, extends through one mortise hole 34 and is attached to a window framing stud 45 in the wall 14. (See FIG. 2.)

Each shutter 24 contains a pair of wooden side rails 46, a wooden top block 48, a wooden bottom block 50 and a plurality of adjustable wooden louvers 52, extending between the side rails 46. Each shutter reinforcing element 26 includes four flat steel bars 54. Each bar 54 has a plurality of apertures 56 and fits against an outer edge of one of the side rails 46, the top block 48 and bottom block 50. A plurality of screws 57 are provided, to extend through the apertures 56 in the bars 54, to secure the bars 54 in place. Each shutter 24 contains four wooden cover strips 58, to cover the four flat steel bars 54.

Each shutter securing paraphernalia 28 consists of a pair of hinges 60. A plurality of screws 62 is affixed to the hinges 60 between one side rail 46 of the shutter 24 and one side jamb 30 of the casing 18. The shutter can swing into and out of the casing 18. A pair of lock assemblies 64 are each in a first instance mounted into the top block 48 and the bottom block 50, adjacent the side rail 46 and in a second instance mounted into the side rail 46 opposite from the hinges 60. The shutter 24 can be locked in place when swung into the casing 18.

Figure 7:
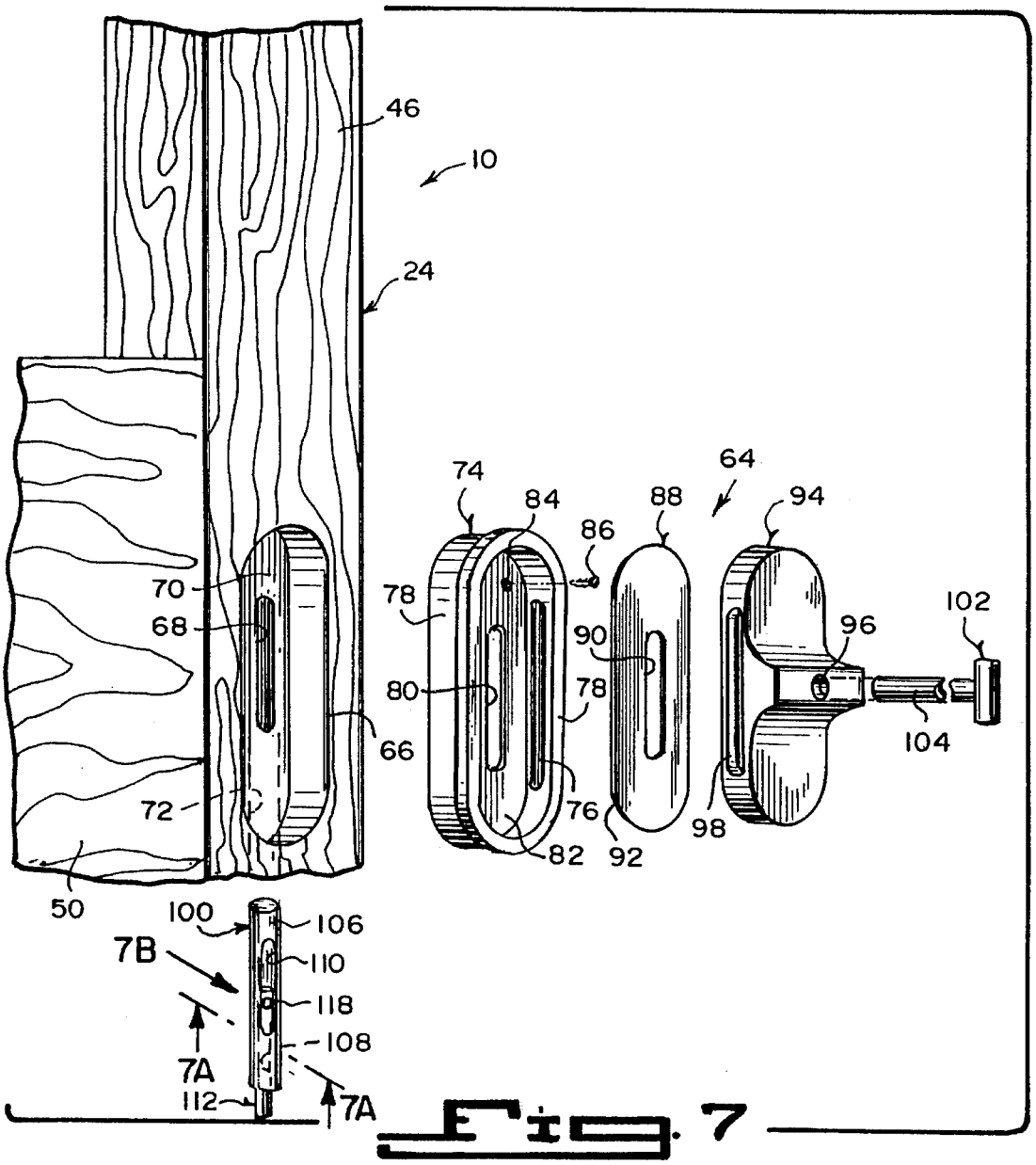
FIG. 7 is an exploded perspective view, showing one of the lock pin assemblies in greater detail.

Each lock pin assembly 64, as shown in FIG. 7, includes either the top block 48, the bottom block 50 and the side rail 46 having a vertical recess 66, a vertical slot 68 within a rear wall 70 within the recess 66 and a vertical bore 72 cooperating with the vertical slot 68. A cup insert 74 has a pair of internal slide grooves 76 in side walls 78, a vertical slot 80 within a rear wall 82 and at least one hole 84 in the rear wall 82. the cup insert 74 fits into the vertical recess 66. At least one mounting screw 86 passes through the at least one hole 84 and threads into the rear wall 70 in the vertical recess 66. A cover plate 88 has a vertical slot 90, with a peel and stick back surface 92 secured against the rear wall 82 of the cup insert 74. A slide member 94 is provided and has a transverse bore 96. A pair of spring clips 98 are also provided. Each spring clip 98 is mounted onto one side of the slide member 94. The slide member 94 fits into the cup insert 74, with each spring clip 98 engaging with one slide groove 76. A lock pin unit 100 extends into the vertical bore 72 behind the vertical recess 66. A lock and release key 102 has a shaft 104 insertable in a removable manner through the transverse bore 96 in the slide member 94, to engage with the lock pin unit 100. The lock and release key 102 can move both the slide member 94 in the insert cup 94 and lock pin unit 100 in the vertical bore 72 into a hole (not shown) in the casing 18. The lock and release key 102 can be removed from the slide member 94, to keep the lock pin unit 100 in the hole in the casing 18.

Figure 7A:
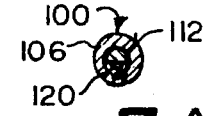
FIG. 7A is a cross sectional view taken along line 7A—7A in FIG. 7.
Figure 7B:
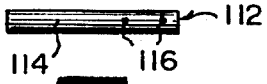
FIG. 7B is a rear view taken in the direction of arrow 7B in FIG. 7 of the lock pin per se.

Each lock pin unit 100, as shown in FIGS. 7 and 7A, consists of a sleeve 106 having a longitudinal aperture 108 therein with a longitudinal slot 110 cooperating with the longitudinal aperture 108. A D-shaped lock pin 112 has a flat side 114 with two spaced apart shallow holes 116 in the flat side 114 (see FIG. 7B) and a depression 118 in an opposite side near a top end. The lock pin 112 is inserted into the longitudinal aperture 108 in the sleeve 106 with the side with the depression 118 facing the longitudinal slot 110 in the sleeve 106. This allows the shaft 104 of the lock and release key 102 to engage with the depression 108 in the lock pin 112. A spring biased ball 120, as shown in FIG. 7A, is carried within the sleeve 106 to engage with either of the shallow holes 116 of the lock pin 112, when the lock pin 112 is lifted up out of the hole and replaced into the hole of the casing 18.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An elegant plantation security shutter assembly for a window in a wall of a building comprising:

a) a casing, said casing including a pair of wooden side jambs, each having a central channel slot and a pair of spaced apart mortise holes, a wooden top jamb, having a central channel slot and a pair of spaced apart mortise holes, and a wooden bottom jamb, having a central channel slot and a pair of spaced apart mortise holes;

b) means for reinforcing said casing, said casing reinforcing means including four flat steel bars, each to fit into the respective central channel slots in said side jambs, said top jamb and said bottom jamb;

c) means for mounting said casing onto the wall behind the window;

d) a pair of shutters;

e) means for reinforcing each said shutter; and f) means for securing each said shutter within said casing, so as to stop a thief from an unauthorized entry through the window into the building, by preventing the thief from breaking said shutters and said casing.

2. An elegant plantation security shutter assembly as recited in claim 1, wherein said casing further includes four wooden front face mouldings, to cover said flat steel bars in central channel slots in said side jambs and said top and bottom jambs.

3. An elegant plantation security shutter assembly as recited in claim 2, wherein said casing mounting means includes eight brackets, each said bracket is affixed to a respective edge of one said flat steel bar, extending through one mortise hole and is attached to a window framing stud in the wall.

4. An elegant plantation security shutter assembly as recited in claim 3, wherein each said shutter includes:

a) a pair of wooden side rails;

b) a wooden top block;

c) a wooden bottom block; and d) a plurality of adjustable wooden louvers extending between said side rails.

5. An elegant plantation security shutter assembly as recited in claim 4, wherein each said shutter reinforcing means includes:

a) four flat steel bars, each said bar having a plurality of apertures and fits against an outer edge of a respective of said side rails, said top block and said bottom block; and b) a plurality of screws to extend through the apertures in said bars, to secure said bars in place.

6. An elegant plantation security shutter assembly as recited in claim 5, wherein each said shutter includes four wooden cover strips to cover said four flat steel bars.

7. An elegant plantation security shutter assembly as recited in claim 6, wherein each said shutter securing means includes:

a) a pair of hinges;

b) a plurality of screws to affix said hinges between one said side rail of said shutter and one said side jamb of said casing, so that said shutter can swing into and out of said casing; and c) a pair of lock pin assemblies each in a first instance mounted into said top block and said bottom block adjacent said side rail and in a second instance mounted into said side rail opposite from said hinges, so that said shutter can be locked in place when swung into said casing.

8. An elegant plantation security shutter assembly as recited in claim 7, wherein each lock pin assembly includes:

a) either said top block, said bottom block and said side rail having a vertical recess, a vertical slot within a rear wall within said recess and a vertical bore cooperating with said vertical slot;

b) a cup insert having a pair of internal slide grooves in side walls, a vertical slot within a rear wall and at least one hole in said rear wall, whereby said cup insert fits into said vertical recess;

c) at least one mounting screw passing through said at least one hole and threads into said rear wall in said vertical recess;

d) a cover plate having a vertical slot with a peel and stick back surface secured against said rear wall of said cup insert;

e) a slide member having a transverse bore;

f) a pair of spring clips, each said spring clip mounted onto one side of said slide member, whereby said slide member fits into said cup insert with each said spring clip engaging with one said slide groove;

g) a lock pin unit which extends into said vertical bore behind said vertical recess; and h) a lock and release key having a shaft insertable in a removable manner through the transverse bore in said slide member to engage with said lock pin unit, so that said lock and release key can move both said slide member in said insert cup and lock pin unit in said vertical bore into a hole in said casing, then said lock and release key can be removed from said slide member to keep said lock pin unit in the hole in said casing.

9. A elegant plantation security shutter assembly as recited in claim 8, wherein each said lock pin unit includes:

a) a sleeve having a longitudinal aperture therein with a longitudinal slot cooperating with said longitudinal aperture;

b) a D-shaped lock pin having a flat side with two spaced apart shallow holes in said flat side and a depression in an opposite side near a top end, whereby said lock pin is inserted into said longitudinal aperture in said sleeve with said side facing said longitudinal slot in said sleeve, to allow said shaft of said lock and release key to engage with said depression in said lock pin; and c) a spring biased ball carried within said sleeve to engage with either of said shallow holes of said lock pin, when said lock pin is lifted up out of the hole and replaced into the hole of said casing.

* * * * *